US005699594A

United States Patent [19]

Czank et al.

[11] Patent Number: 5,699,594

[45] Date of Patent: Dec. 23, 1997

[54] SEAT BELT BUCKLE SPRING

[75] Inventors: Stephen C. Czank, Shelby Township; Robert J. Desmarais, Almont; Stephen M. Arnold, Yale, all of Mich.

[73] Assignee: TRW Vehicle Safety Systems, Inc., Lyndhurst, Ohio

[21] Appl. No.: 520,138

[22] Filed: Aug. 28, 1995

[51] Int. Cl.[6] ..... A44B 11/26

[52] U.S. Cl. ..... 24/632; 24/637

[58] Field of Search ..... 24/631, 632, 637, 24/573.5; 297/484

[56] References Cited

U.S. PATENT DOCUMENTS 3,440,697 4/1969 Proctor .
3,483,599 12/1969 Fisher .
3,494,007 2/1970 Dahms .
4,393,557 7/1983 Schmidt .
4,575,908 3/1986 Gloomis et al. .
4,642,857 2/1987 Ono .
4,660,260 4/1987 Ishiguro .
5,005,267 4/1991 Sugimoto .

*Primary Examiner*—James R. Brittain
*Attorney, Agent, or Firm*—Tarolli, Sundheim, Covell, Tummino & Szabo

[57] ABSTRACT

A buckle (20) comprises a base (80) which defines a cavity (88) for receiving first and second tongues (62, 64) of a vehicle seat belt system. A latch plate (102) is supported by the base (80) and is movable between a latched position connecting the first and second tongues (62, 64) with the base and a release position in which the first and second tongues are disconnected from the base. A pushbutton (222) is movable to an actuated position to move the latch plate (102) from the latched position to the release position. A spring (260) is located in the cavity (82) and is connected to the latch plate (102). The spring (260) has a portion (262) which urges the latch plate (102) toward the latched position. The spring (260) has another portion (264) which extends between the first and second tongues (62, 64) to urge the pushbutton (222) away from the actuated position.

14 Claims, 6 Drawing Sheets

SEAT BELT BUCKLE SPRING

FIELD OF THE INVENTION

The present invention relates to a buckle for a vehicle seat belt system.

BACKGROUND OF THE INVENTION

A known vehicle seat belt system includes a seat belt buckle and a tongue associated with a portion of seat belt webbing. The buckle is typically fixed to a part of the vehicle. The buckle receives the tongue and connects the tongue with the buckle.

The buckle typically includes a latch for latching the tongue in the buckle. The latch is movable between a first position in which the tongue is latched to the buckle and a second position in which the tongue is not latched to the buckle. The buckle also typically includes a release button which is movable between an unactuated position and an actuated position. The latch moves to the second position in which the tongue is not latched to the buckle in response to the release button being moved to the actuated position. The latch is typically biased toward the first position and the release button is typically biased towards the unactuated position.

SUMMARY OF THE INVENTION

The present invention is directed to a buckle for a vehicle seat belt system. The buckle receives first and second tongues of the seat belt system. The buckle comprises a base which at least partially defines a cavity for receiving the first and second tongues. A latch plate is supported by the base and is located in the cavity. The latch plate is movable between a latched position connecting the first and second tongues with the base and a release position in which the first and second tongues are disconnected from the base.

A manually engageable pushbutton is supported for movement relative to the base and is engageable with the latch plate. The pushbutton is movable from an unactuated position to an actuated position. The latch plate moves from the latched position to the release position in response to the pushbutton moving from the unactuated position to the actuated position.

Biasing means is located in the cavity. The biasing means is attached to the latch plate. The biasing means has a first portion urging the latch plate towards the latched position. The biasing means also has a second portion extending between the first and second tongues. The second portion urges the pushbutton towards the unactuated position.

Preferably, the force exerted by the first portion of the biasing means on the latch plate is greater than the force exerted by the second portion of the biasing means on the pushbutton. Also, preferably, the latch plate pivots relative to the base and the pushbutton pivots relative to the base.

The biasing means comprises a U-shaped spring having a pair of resilient legs connected by a mounting portion. The mounting portion of the U-shaped spring is attached to the latch plate at an end of the latch plate about which the latch plate pivots. The first portion of the biasing means comprises one of the resilient legs which engages the base and urges the latch plate away from the base to the latched position. The second portion of the biasing means comprises another of the resilient legs and extends between the first and second tongues. The other resilient leg engages the pushbutton and urges the pushbutton away from the base to the unactuated position.

BRIEF DESCRIPTION OF THE DRAWINGS

Other features and advantages of the present invention will become apparent to those skilled in the art to which the present invention relates from reading the following specification with reference to the accompanying drawings, in which.

DESCRIPTION OF A PREFERRED EMBODIMENT

Figure 1:
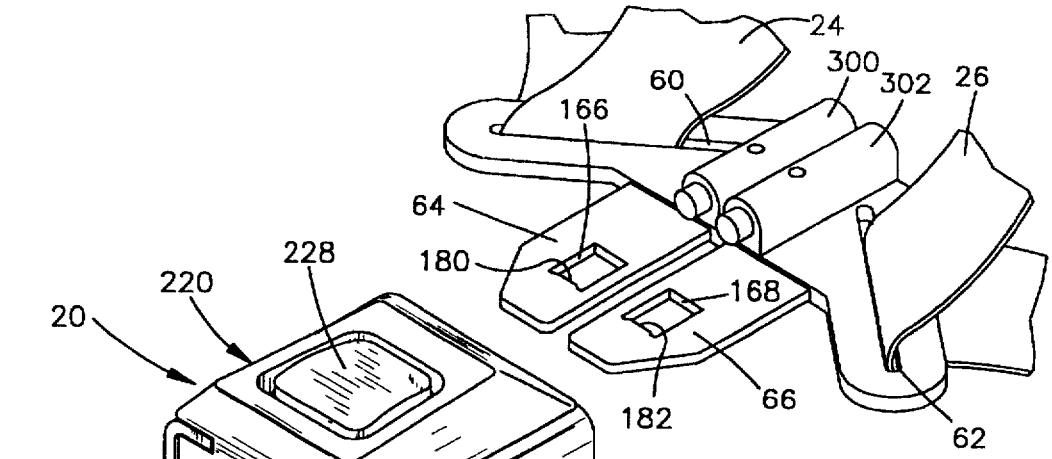
FIG. 1 is a perspective view of a buckle and a pair of seat belt tongues.

A vehicle seat belt system for a child includes a buckle 20, as illustrated in FIG. 1. The seat belt system also includes a crotch belt 22 and a pair of shoulder belts 24, 26. The buckle 20 is connected to an end loop 28 (FIGS. 1, 3 and 4) of the crotch belt 22. The shoulder belt 24 extends through a slot 60 (FIG. 1) in a tongue 64. The shoulder belt 26 extends through a slot 62 in a tongue 66.

Each of the shoulder belts 24, 26 has a portion extendable across a shoulder of a child occupying the seat and a portion extendable across a hip of the child. The crotch belt 22 extends upwardly from a seat cushion and is extendable between the legs of the child occupying the seat. The buckle 20 receives the tongues 64, 66 to connect the crotch belt 22 with the shoulder belts 24, 26 and secure the child in the seat.

The buckle 20 (FIGS. 3–5) includes a metal base 80 with a longitudinal central axis A. The base 80 has a bottom 82 and a pair of laterally spaced sides 84, 86. The bottom 82 and sides 84, 86 cooperate to partially define a cavity 88 in the buckle 20 for receiving the tongues 64, 66. The tongues 64, 66 are movable into the cavity 88 in the buckle 20 through an entrance opening 90 at one axial end of the base 80. A slot 100 in the opposite axial end portion of the base 80 receives the end loop 28 of the crotch belt 22.

Figure 6:
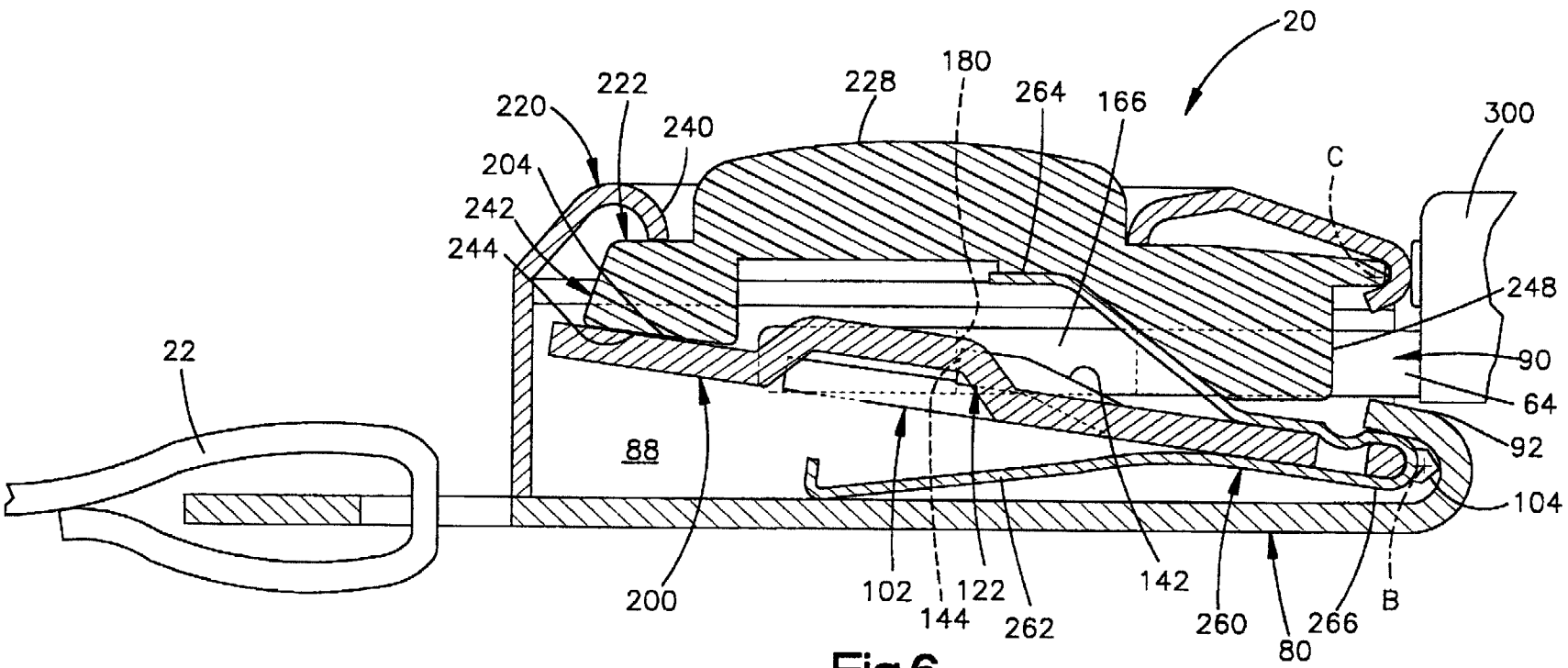

A generally planar metal latch plate 102 is supported by the base 80. The latch plate 102 pivots about an axis B (FIGS. 2–4) at one end 104 in the cavity 88. The axis B extends in a direction normal to the axis A of the base 80. The latch plate 102 is pivotable between a latched position connecting the tongues 64, 66 with the base 102, as illustrated in FIG. 6, and a release position in which the tongues are not connected with the base, as illustrated in FIG. 4.

The end 104 of the latch plate 102 is supported by the base 80 at a location axially opposite the slot 100. A lip 92 is formed on the base 80 at the entrance opening 90 to the cavity 88 in the buckle 20. The lip 92 of the base 80 traps the end 104 of the latch plate 102 and prevents the latch plate from exiting the cavity 88 through the entrance opening 90. A centrally located notch 106 is formed in the end 104 of the latch plate 102.

The latch plate 102 (FIGS. 2 and 3) has a pair of latch lugs 122, 124. The latch lugs 122, 124 are stamped in the latch plate 102 and extend upwardly, as viewed in FIGS. 3 and 5, from a planar main portion 126 of the latch plate. The latch lug 122 has a cam surface 142 and an end surface 144. The cam surface 142 extends at a relatively small angle from the planar main portion 126 of the latch plate 102 and faces the entrance opening 90 of the buckle 20. The end surface 144 of the latch lug 122 faces in a direction away from the entrance opening 90 of the buckle 20.

The latch lug 124 has a cam surface 146 and an end surface 148. The cam surface 146 extends at a relatively small angle from the planar main portion 126 of the latch plate 102 and faces the entrance opening 90 of the buckle 20. The end surface 148 of the latch lug 124 faces in a direction away from the entrance opening 90 of the buckle 20.

The latch plate 102 also has a pair of laterally spaced guides 162, 164 located outside of the latch lugs 122, 124 relative to the middle of the latch plate which extends along the axis A. The guides 162, 164 are coplanar with and extend axially away from the planar main portion 126 of the latch plate 102. The guides 162, 164 are in the cavity 88 at a location adjacent the sides 84, 86 of the base 80. The guides 162, 164 can engage the sides 84, 86 of the base to limit rotation of the latch plate 102 in the cavity 88 about an axis extending normal to the bottom 82 of the base 80.

Latch openings 166, 168 are provided in the tongues 64, 66. Surfaces 180, 182 of the tongues 64, 66 at least partially define the latch openings 166, 168 and face in a direction opposite to the direction that the end surfaces 144, 148 of the latch lugs 122, 124 face. The latch lugs 122, 124 enter the latch openings 166, 168 (FIGS. 1 and 3) in the tongues 64, 66 when the tongues are fully advanced into the buckle 20. When the latch lugs 122, 124 are located in the latch openings 166, 168, the tongues 64, 66 are connected with the base 80. The end surfaces 144, 148 of the latch lugs 122, 124 engage the latch plate surfaces 180, 182 that define the latch openings 166, 168. Engagement between the end surfaces 144, 148 of the latch lugs 122, 124 and the surfaces 180, 182 of the tongues 64, 66 prevents withdrawal of the tongues from the cavity 88 in the buckle 20.

The latch plate 102 also includes a member 200 which extends axially from the main planar portion 126 between the guides 162, 164. The member 200 is centered on the latch plate 102, as viewed in FIG. 4, and extends along the axis A of the base 80. The member 200 includes a tab portion 202 which is raised from the planar main portion 126, as viewed in FIGS. 2 and 4. The member 200 also includes an actuator portion 204 which is located at the end of the member and is coplanar with the planar main portion 126.

A cover 220 is secured to the base 80. A one-piece molded plastic pushbutton 222 is supported by the cover 220. The pushbutton 222 has an end portion 224 (FIGS. 3 and 4) held in a lip 226 formed at an end of the cover 220. The pushbutton 222 pivots about an axis C (FIG. 5) in the end portion 224. The axis C extends substantially parallel to the axis B in the end 104 of the latch plate 102. The pushbutton 222 pivots from an unactuated position to an actuated position for moving the latch plate 102 from its latched position to its release position.

The pushbutton 222 has a manually engageable surface 228 extending through an opening 240 in the cover 220. A downwardly depending actuator lug 244 (FIGS. 2 and 4) is formed in one piece with the pushbutton 222 at an end portion 242 which is located axially opposite the end portion 224. The actuator lug 244 is located centrally on the pushbutton 222 and is engageable with the actuator portion 204 at the end of the member 200 on the latch plate 102.

Figure 7:
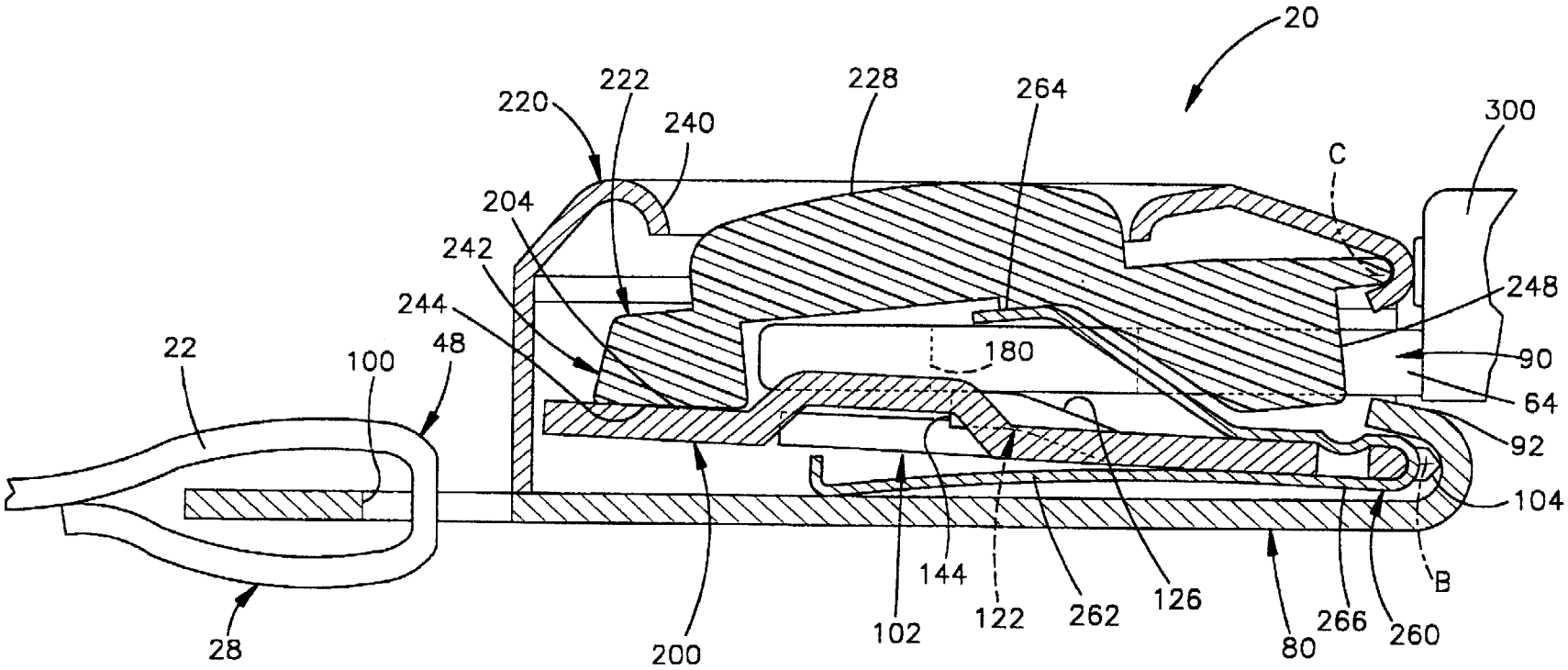

In response to the surface 228 being manually engaged and pressed downward in the opening 240, the pushbutton 222 pivots counterclockwise about the axis C, as viewed in FIG. 7, and the actuator lug 244 contacts the actuator portion 204 of the member 200. The actuator lug 244 transmits the pivoting movement of the pushbutton 222 to the latch plate 102 through the actuator portion 204 at the end of the member 200. The latch plate 102 pivots counterclockwise about the axis B at the end 104 to the release position in response to engagement and pivoting by the pushbutton 222.

A divider 248 (FIGS. 3 and 5) is formed in one piece with the pushbutton 222 and extends downwardly from the end portion 224. The divider 248 splits the entrance opening 90 in half and separates an insertion path P1 of the tongue 64 from an insertion path P2 of the tongue 66. The divider 248 thus guides each of the tongues 64 and 66 along its respective insertion path P1 or P2 during movement of the tongues into the cavity 88. As the tongues 64, 66 advance into the cavity 88 in the buckle 20, the divider 248 blocks movement of each tongue into the insertion path P1 or P2 of the other tongue. The divider 248 also helps align the latch openings 166, 168 in the tongues 64, 66 with their associated latch lugs 122, 124.

A spring 260 (FIGS. 2, 3 and 4) is provided to exert a biasing force on the latch plate 102 and the pushbutton 222. The spring 260 is made of spring steel and has a U-shape, as viewed from the side in FIGS. 4–7, with a substantially uniform thickness. The spring 260 is attached to the latch plate 102 at a central location along the axis A of the base 80. The spring 260 includes a pair of resilient legs 262, 264 extending from a mounting portion 266.

The mounting portion 266 of the spring 260 is resilient and is received in the notch 106 in the end 104 of the latch plate 102. The mounting portion 266 clamps against opposite sides of the planar main portion 126 of the latch plate 102 as illustrated in FIG. 4. The mounting portion 266 is located between the end 104 of the latch plate 102 and the lip 92 of the base 80

Figure 2:
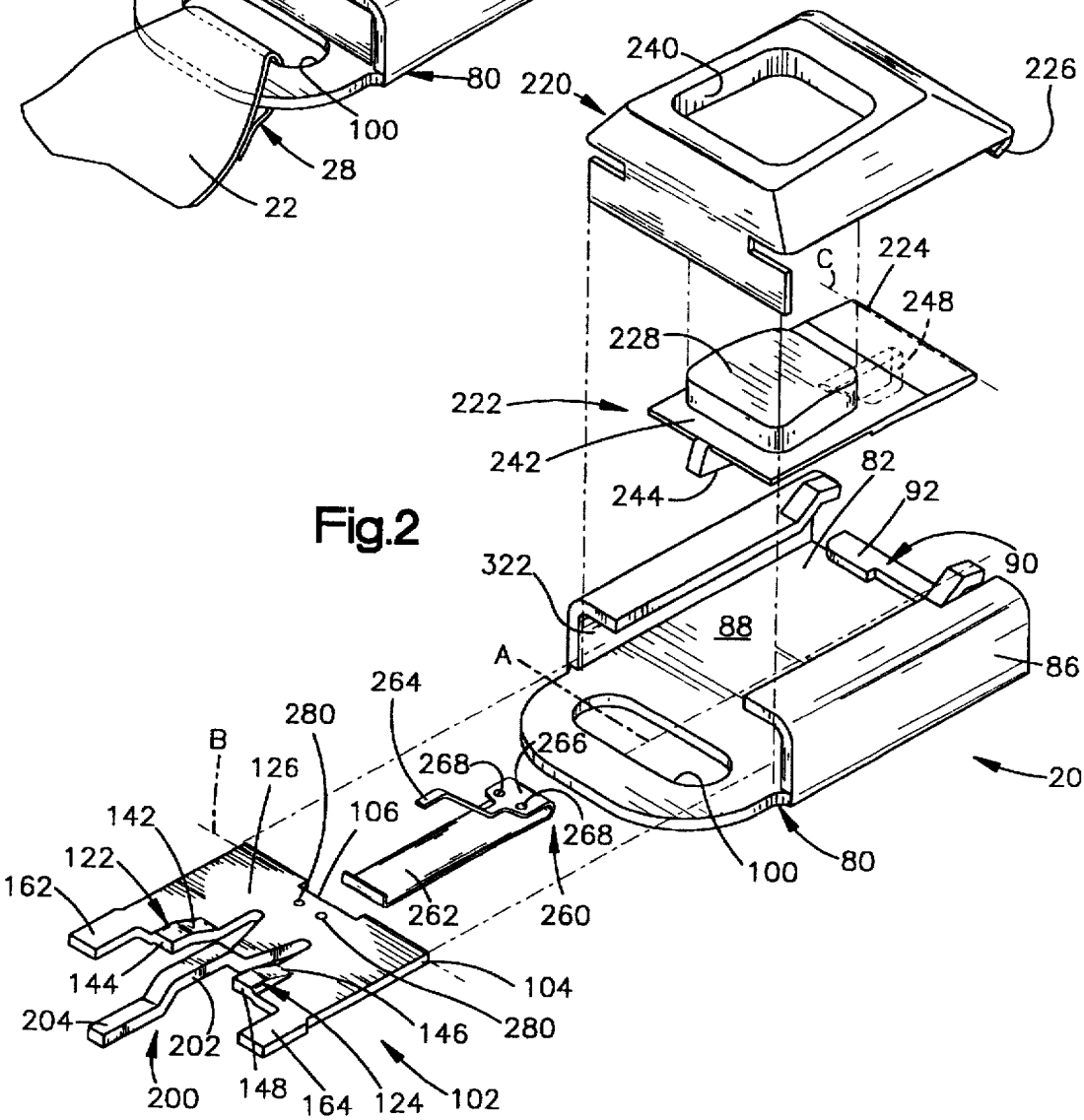
FIG. 2 is an exploded perspective view of the buckle of FIG. 1.
Figure 3:
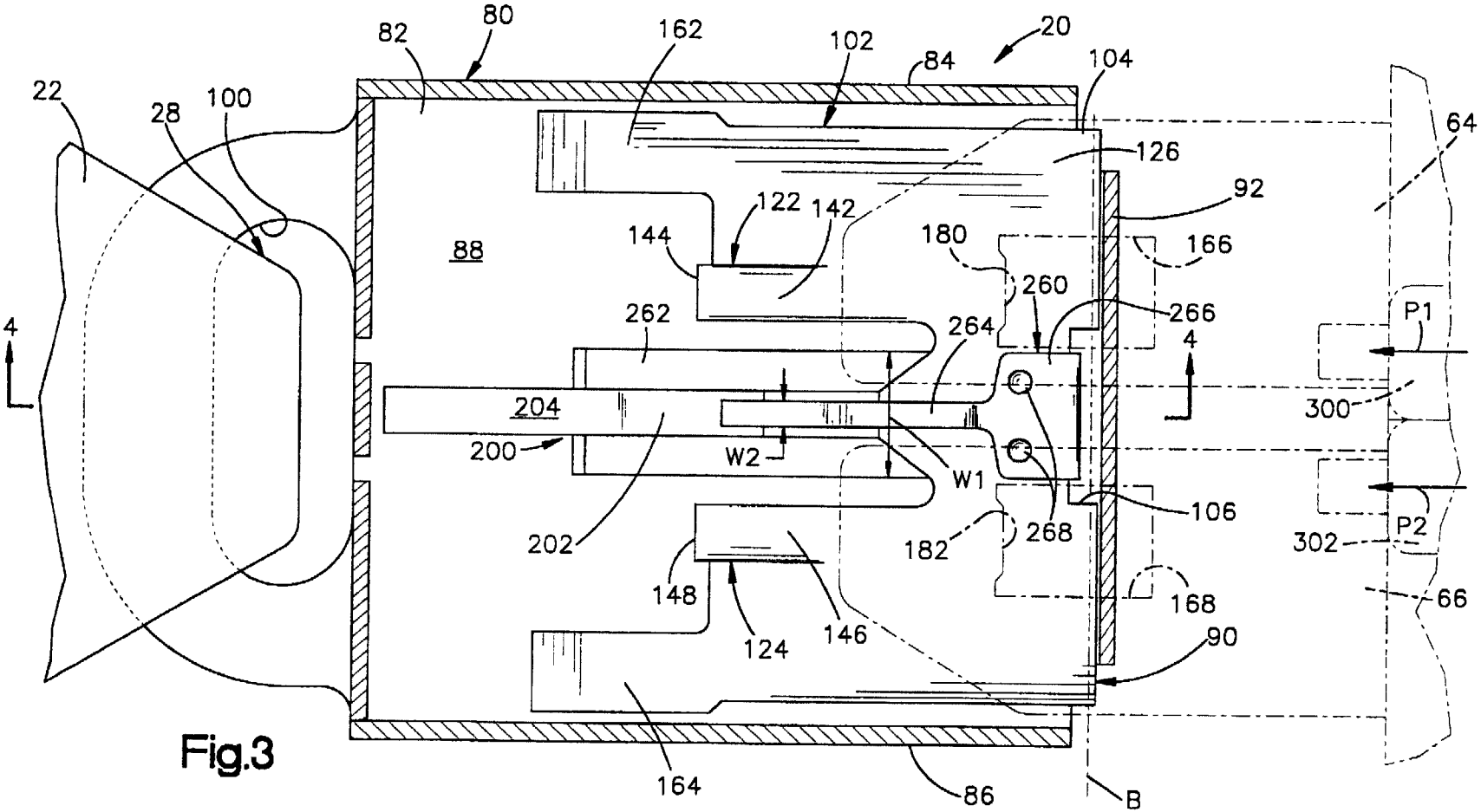
FIG. 3 is a plan view, partly in section, of the buckle of FIG. 1.
Figure 4:
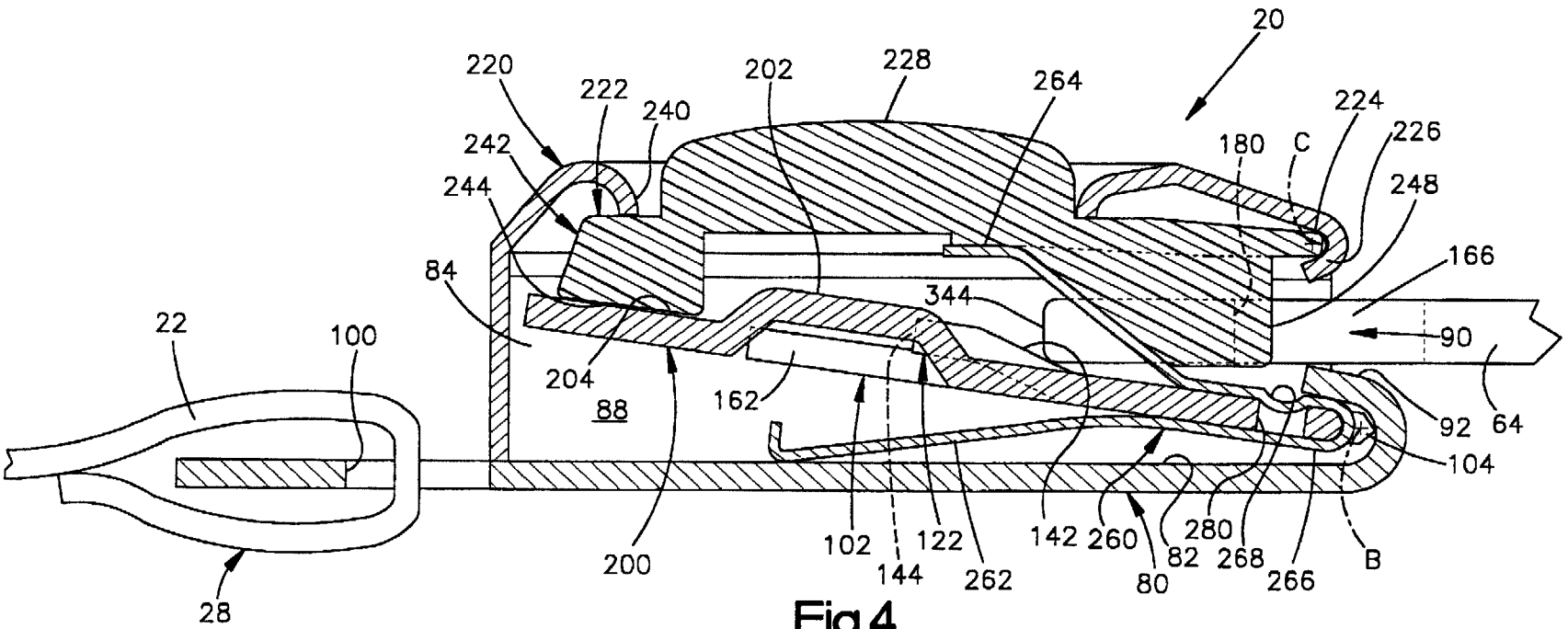
FIG. 4 is a sectional view of the buckle of FIG. 3, taken approximately along the line 4—4 in FIG. 3.

The mounting portion 266 of the spring 260 includes a pair of inwardly projecting dimples 268 (FIGS. 2–4). The dimples 268 are received in openings 280 formed in the end 104 of the latch plate 102 near the notch 106. The spring 260 is retained on the latch plate 102 when the dimples 268 are located in the openings 280. The dimples 268 in the openings 280 and the resilient clamping force of the mounting portion 266 inhibit relative movement between the spring 260 and latch plate 102.

The lower leg 262 of the spring 260, as viewed in FIGS. 2 and 4–7, is located between a portion of the latch plate 102 and the bottom 82 of the base 80. The lower leg 262 of the spring 260 engages the bottom 82 of the base 80 and urges the latch plate 102 to pivot clockwise, as viewed in FIG. 5, about the axis B with a first biasing force. The latch plate 102 is urged by the lower leg 262 of the spring 260 to pivot about the axis B relative to the base 80 in a direction towards the latched position and away from the bottom 82 of the base, as illustrated in FIGS. 4 and 6. The lower leg 262 of the spring 260 has a width W1 (FIG. 3), measured in a direction perpendicular to the axis A of the base 80.

Figure 5:
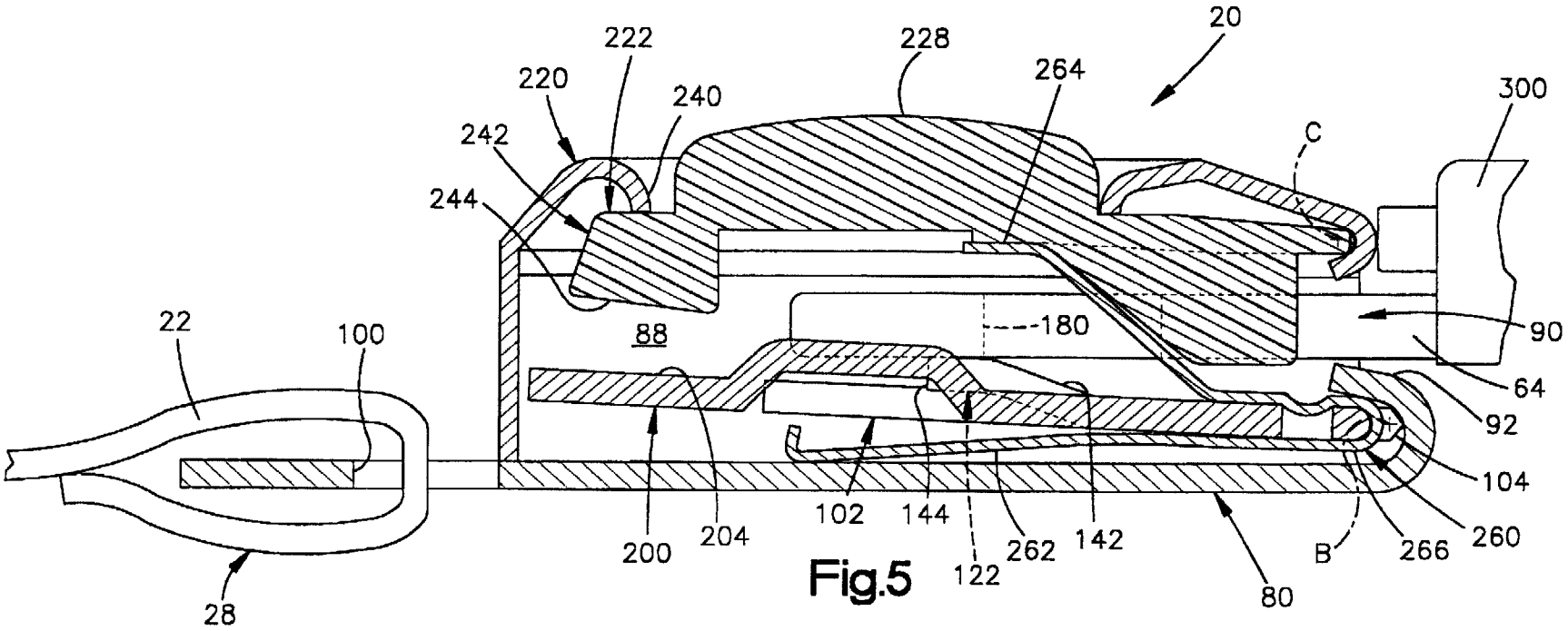
FIGS. 5–7 are views similar to FIG. 4 with parts in different positions.

The upper leg 264 of the spring 260 is located between the tongues 64, 66, as illustrated in FIG. 3, when the tongues are in the cavity 88 in the buckle 20. The upper leg 264 is also located outside of both of the insertion paths P1, P2 of the tongues 64, 66. The upper leg 264 of the spring 260 engages the pushbutton 222 at a location below the surface 228. The pushbutton 222 is urged by the upper leg 264 to pivot towards the unactuated position in a direction about the axis B away from the bottom 82 of the base 80, as illustrated in FIGS. 4–6, with a second biasing force. The second biasing force that the upper leg 264 exerts against the pushbutton 222 is sufficient to maintain the pushbutton in the unactuated position even when the vehicle incorporating the buckle 20 is operated on rough or uneven surfaces. The second biasing force of the upper leg 264 is overcome by a manual force applied to the pushbutton 222.

The upper leg 264 of the spring 260 has a width W2, measured in a direction perpendicular to the axis A of the base 80, which is less than the width W1 of the lower leg 262. The widths W1 and W2 of the legs 262, 264 determine the first and second biasing forces exerted by the respective legs when the buckle 20 is assembled. The first biasing force of the lower leg 262 is greater than the second biasing force of the upper leg 264 by a factor in the range of two to twenty times. Thus the spring 260 is attached to the latch plate 102 and has a first portion biasing the latch plate with a first biasing force and a second portion biasing the pushbutton 222 with a second biasing force which is less than the first biasing force.

When an occupant, such as a child, is to be secured in a seat by the seat belt system, the shoulder belts 24 and 26 are positioned around the shoulders and hips of the child. The crotch belt 22 extends upward between the legs of the child. The tongues 64, 66 are then inserted into the buckle 20. The shoulder belts 24, 26 and the crotch belt 22 are connected around the child to secure the child in the seat.

Each of the tongues 64, 66 is moved into the cavity 88 in the buckle 20 through the entrance opening 90, as illustrated in FIG. 3. The tongue 64 is moved into the cavity 88 in the buckle 20 along the insertion path P1. The insertion path P1 is defined on the top by the lip 226 of the cover 220 and on the bottom by the lip 92 of the base 80. The outer side of the insertion path P1 is defined by the side 84 of the base 80. The inner side of the insertion path P1 is defined by the divider 248 of the pushbutton 222, the upper leg 264 of the spring 260, and the tab portion 202 of the member 200.

The tongue 66 is inserted into the cavity 88 in the buckle 20 along the insertion path P2. The insertion path P2 is defined on the top by the lip 226 of the cover 220 and on the bottom by the lip 92 of the base 80. The outer side of the insertion path P2 is defined by the side 86 of the base 80. The inner side of the insertion path P2 is defined by the divider 248 of the pushbutton 222, the upper leg 264 of the spring 260, and the tab portion 202 of the member 200.

When the tongues 64, 66 are inserted into cavity 88 of the buckle 20, the tongue 64 engages the cam surface 142 on the latch lug 122, as illustrated in FIG. 4. The tongue 66 engages the cam surface 146 on the latch lug 124. As the tongues 64, 66 advance in the cavity 88, the latch plate 102 pivots counterclockwise about the axis B in a direction towards the bottom 82 of the base 80, as viewed in FIG. 5. The lower leg section 262 of the spring 260 resists counterclockwise pivotal movement of the latch plate 102. The insertion force of the tongues 64, 66 against the cam surfaces 142, 146 of the latch plate 102 overcomes the first biasing force of the lower leg 262 of the spring 260, as illustrated in FIG. 5. The latch plate 102 continues to pivot in the counterclockwise direction as the tongues 64, 66 advance into the cavity 88 to the position illustrated in FIG. 6.

When the tongues 64, 66 reach the position illustrated in FIG. 6, the latch lugs 122, 124 are aligned with the latch openings 166, 168 in the tongues. The latch plate 102 can then pivot clockwise about the axis B under the first biasing force of the lower leg 262 of the spring 260, as illustrated in FIG. 6. The latch lugs 122 and 124 are received in the latch openings 166 and 168 in the tongues 64 and 66 to connect the tongues 64, 66 with the base 80 of the buckle 20. The end surfaces 144, 148 of the latch lugs 122, 124 engage the surfaces 180, 182 of the tongues 64, 66 and hold the tongues in the buckle 20. The shoulder belts 24 and 26 are connected with the crotch belt 22, and the child is secured against movement out of the seat.

To release the tongues 64, 66 from the buckle 20, the surface 228 of the pushbutton 222 is manually depressed to pivot to the actuated position in a direction towards the bottom 82 of the base 80, as illustrated in FIG. 7. The pushbutton 222 pivots counterclockwise about the axis C, as viewed in FIG. 7, against the second biasing force of the upper leg 264 of the spring 260. The actuator lug 244 on the pushbutton 222 engages the actuator portion 204 at the end of the member 200. The pushbutton 222 transmits a force to the latch plate 102 and pivots the latch plate counterclockwise about the axis B. The counterclockwise pivoting of the latch plate 102 is resisted by the first biasing force of the lower leg 262 of the spring 260. The manual force applied to the pushbutton 222 also overcomes the first biasing force that the lower leg 262 of the spring 260 exerts on the latch plate 102.

The latch lugs 122, 124 move out of the latch openings 166, 168 in the tongues 64, 66, respectively, in response to a predetermined amount of counterclockwise pivoting by the latch plate 102. The tongues 64, 66 are no longer connected with the buckle 20 and are free to be removed or withdrawn from the buckle. The tongues 64, 66 may also be provided with spring loaded ejectors 300, 302, as is known, to aid in moving the tongues in a direction away from the buckle 20.

From the above description of the invention, those skilled in the art will perceive improvements, changes and modifications. Such improvements, changes and modifications within the skill of the art are intended to be covered by the appended claims.

Having described the invention, the following is claimed:

1. A buckle comprising:

a base for receiving first and second tongues of a vehicle seat belt system;

latch means supported by said base for connecting the first and second tongues with said base, said latch means being movable between a first position connecting the first and second tongues with said base and a second position at which the first and second tongues are disconnected from said base;

a pushbutton movable to an actuated position to move said latch means from the first position to the second position; and biasing means having a first portion for biasing said latch means toward the first position and a second portion to be located between the tongues when the tongues are received by said base, said second portion biasing said pushbutton away from the actuated position.

2. The buckle of claim 1 wherein said biasing means comprises a U-shaped spring, said first and second portions of said biasing means comprising a pair of resilient legs of said U-shaped spring connected by a mounting portion of said U-shaped spring.

3. The buckle of claim 2 wherein said latch means comprises a plate and said mounting portion of said U-shaped spring is attached to said plate.

4. The buckle of claim 2 wherein one of said resilient legs of said U-shaped spring engages said pushbutton and biases said pushbutton away from said base.

5. The buckle of claim 2 wherein one of said resilient legs of said U-shaped spring engages said base and biases said latch means away from said base.

6. A buckle for receiving first and second tongues of a vehicle seat belt system, said buckle comprising:

a base at least partially defining a cavity for receiving the first and second tongues;

a latch plate supported by said base, said latch plate being movable between a latched position connecting the first and second tongues with said base and a release position permitting the first and second tongues to disconnect from said base;

a pushbutton movable from an unactuated position to an actuated position to move said latch plate from the latched position to the release position; and biasing means attached to said latch plate and having a portion for urging said latch plate toward the latched position and another portion for urging said pushbutton toward the unactuated position, said another portion extending between the first and second tongues when the tongues are received in the cavity.

7. The buckle of claim 6 wherein said biasing means comprises a U-shaped spring having a pair of resilient legs connected by a mounting portion.

8. The buckle of claim 7 wherein said latch plate is pivotable and said mounting portion of said U-shaped spring is attached to an end of said latch plate at which said latch plate pivots.

9. The buckle of claim 7 wherein said pushbutton is pivotable and one of said resilient legs of said U-shaped spring comprises said another portion and engages said pushbutton and biases said pushbutton to pivot away from said base.

10. The buckle of claim 8 wherein one of said resilient legs of said U-shaped spring engages said base and biases said latch plate to pivot away from said base.

11. A buckle for receiving first and second tongues of a vehicle seat belt system, said buckle comprising:

a base at least partially defining a cavity for receiving first and second tongues;

a latch plate supported by said base in the cavity, said latch plate being pivotable between a first position blocking withdrawal of the first and second tongues from said base and a second position permitting withdrawal of the first and second tongues from said base;

a pushbutton pivotable from a position disengaged from said latch plate to a position engaged with said latch plate to cause said latch plate to pivot from the first position to the second position; and a spring including a first portion urging said latch plate toward the first position and a second portion extending between the first and second tongues when the tongues are in the cavity, said second portion urging said pushbutton toward the disengaged position.

12. The buckle of claim 11 wherein said spring is U-shaped and wherein said first and second portions comprise a pair of resilient legs of said U-shaped spring connected by a mounting portion of said U-shaped spring.

13. The buckle of claim 12 wherein said mounting portion of said U-shaped spring is attached to an end of said latch plate at which said latch plate pivots.

14. The buckle of claim 11 wherein said first portion of said spring exerts a first force on said latch plate which is greater than a second force exerted by said second portion of said spring on said pushbutton.

* * * * *